US006415572B1

(12) United States Patent
MacKarvich

(10) Patent No.: US 6,415,572 B1
(45) Date of Patent: Jul. 9, 2002

(54) ADJUSTABLE PROTECTOR SHOE FOR TIE DOWN STRAP

(76) Inventor: Charles J. MacKarvich, 3940 Paces Manor Dr., Atlanta, GA (US) 30339

( * ) Notice: Subject to any disclaimer, the term of this patent is extended or adjusted under 35 U.S.C. 154(b) by 0 days.

(21) Appl. No.: 09/694,906

(22) Filed: Oct. 24, 2000

(51) Int. Cl.[7] ..... E04C 5/01

(52) U.S. Cl. ..... 52/357; 52/359; 52/360; 52/715

(58) Field of Search ..... 52/359, 360, 357, 52/715, DIG. 11, 143; 248/499, 500, 680; 403/11, 12

(56) References Cited

U.S. PATENT DOCUMENTS 1,286,233 A * 12/1918 Cockerell ..... 52/359
1,805,648 A * 5/1931 Venzie ..... 52/359
5,359,151 A * 10/1994 Nattel ..... 174/48
5,482,395 A * 1/1996 Gasparini ..... 403/384
5,983,573 A * 11/1999 MacKarvich ..... 52/23
6,176,056 B1 * 1/2001 MacKarvich ..... 52/293.3

* cited by examiner

*Primary Examiner*—Carl D. Friedman
*Assistant Examiner*—Jennifer I. Thissell
(74) *Attorney, Agent, or Firm*—Thomas, Kayden, Horstemeyer & Risley

(57) ABSTRACT

Protector shoe (10) is positioned between the loop (49) formed in a tie down strap (46) and the adjacent support plate (36, 38). The mounting flange (24) extends about a first edge (40) of the support plate (36) and the middle strip (28) of the tail (22) is folded about the second edge (41) either by the installer or by the application of the loop of the tie down strap urging it toward engagement with and about the second edge (41) of the support plate. This protects the tie down strap from abrasion against the edges (40 and 41) of the support plate (36) of the support beam (12).

9 Claims, 2 Drawing Sheets

ADJUSTABLE PROTECTOR SHOE FOR TIE DOWN STRAP

FIELD OF THE INVENTION

This invention involves tie down straps for premanufactured buildings, the straps being used to tie down the frame of a building to a ground anchor adjacent the building structure. More particularly, the invention relates to a protector shoe that is placed about the support beam of the premanufactured building so as to protect the surface of the tie down strap from engagement with the edge of the support beam, thereby avoiding abrasion and cracking of the tie down strap.

BACKGROUND OF THE INVENTION

Premanufactured buildings, such as mobile homes, trailers, prefabricated houses, and the like are manufactured at a central manufacturing site, and upon completion are moved to a location where they are placed on a foundation and occupied. Because these homes are designed to be easily moved from one site to another, they are not built on a permanent foundation but are built on a pair of parallel support beams, such as I-beams, and the structure is temporarily mounted on wheels for transport to an erection site where the wheels are removed and the building can be installed permanently. Usually, when the building is installed the support beams are placed on piers, such as concrete blocks, and the building is anchored to the ground.

Typically, the anchoring process involves the use of ground anchors and tie down straps extending from the ground anchors at an upward slope to the support beams, to hold the support beams to the ground. Anchoring the premanufactured building structure to the ground in this manner helps to avoid movement of the building structure in response to wind forces and earth tremors.

In some of the anchoring arrangements, the tie down straps are looped around a support beam and the end of the strap connected back on the strap, so that the loop formed in the strap surrounds the support beam. The other end of the strap is connected to the upper portion of a ground anchor, and tension is applied to the strap. When the tension forces are applied to the strap, the looped portion of the strap engages the opposed side edges of the support plates of the I-beam. This engagement results in forming angular folds in the tie down strap about the edges of the support beam, and the edges of the support beam tend to abrade and crack the tie down straps at their folds.

In the past, some of the installers have attempted to avoid the strap abrasion and cracking problem by placing a segment of the tie down strap material about the support beam and then placing the above described loop of the tie down strap about the segment of tie down material. With this arrangement, the segment of tie down material surrounding the support beam forms an intermediate shield between the loop of the tie down strap and the relatively sharp edges of the support beam, which helps to avoid the above noted problems of abrasion and cracking.

While the use of short segments of tie down straps as described above helps to alleviate the described problems, there are many occasions when the installer does not properly align the segment of tie down strap material inside the loop of the tie down strap. This misalignment of the segment with respect to the loop in the tie down strap is likely to cause the segment to be partially displaced from the loop at one or the other ends of the segment, or partially displaced long its entire length under the loop. Moreover, there are times when the segment is displaced longitudinally of its length so that it does not cover an edge of the support beam, or the strap may be cut to an improper length, leaving an edge of the beam uncovered.

The invention disclosed herein helps to solve the above noted problems.

SUMMARY OF THE INVENTION

Briefly described, the present invention comprises a protector shoe for a tie down strap engaged about a support beam of a tied down premanufactured building structure. The protector shoe is formed of sheet metal and includes a flat body panel for placement on the flat surface of the upper or lower support plate of an I-beam or similar support beam. An edge engagement means, such as a mounting flange, is formed on an edge of the body panel and extends at an angle with respect to the body panel for engagement with a first edge of a support plate of a support beam. A tail extends from the body panel and opposes the mounting edge of the body panel. The tail is formed in strips of a length for overlying the support plate and extending beyond the second edge of the support plate when the mounting flange engages the first edge of the support plate. One or more of the tail strips is to be bent or formed about the second edge of the support plate of the support beam.

The tie down strap is placed about the protector shoe, with the mounting flange protecting the strap from engagement with the first edge of the support plate of the support beam, and one or more tail strips being folded about the second edge of the support plate, either by the worker or the force applied by the tie down strap, so that the tail strip protects the tie down strap against engagement with the second edge of the support plate.

If needed, a second protector shoe can be applied to the opposite support plate of the support beam in the same way, to protect the loop formed by the tie down strap.

The tail strips typically will comprise three parallel tail strips, a middle strip and side strips straddling the middle strip. The space between the side strips will be formed at least as great as the width of the tie down strap. With this arrangement, the tie down strap typically engages only the middle strip and forms the middle strip about the edge of the support plate of the support beam, leaving the side strips unfolded. This tends to center the tie down strap between the side strips, so that the tie down strap extends across the central portion of the protector shoe, avoiding the protector shoe from sliding out from beneath the tie down strap.

In some instances, the installer might not properly place the tie down strap between the side tail strips of the support shoe, in which case the side strips will not form an obstruction to the placement of the tie down strap, but will become folded or bent in the same manner as the middle strip of the protector shoe.

Thus, it is an object of this invention to provide improved protection for a tie down strap at the folds of the tie down strap as it surrounds a support beam of a premanufactured building structure anchored to the ground.

Another object of the invention is to provide a protector shoe for the tie down strap extending from a ground anchor upwardly to a support beam of a premanufactured building, with the support shoe accommodating tie down straps and support beams of different sizes and shapes.

Another object of the invention is to provide a protector shoe for protecting the tie down strap of a ground anchor from abrasion and cracking when contacting the support beam of a premanufactured building.

Other objects, features and advantages of the present invention will become apparent upon reading the following specification when taken in conjunction with the accompanying drawings.

DETAILED DESCRIPTION OF THE INVENTION

Figure 1:
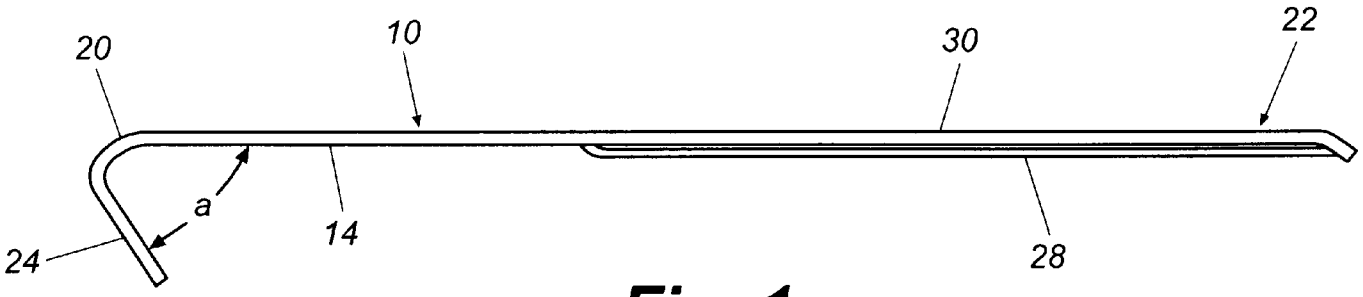
FIG. 1 is a side view of the protector shoe.
Figure 2:
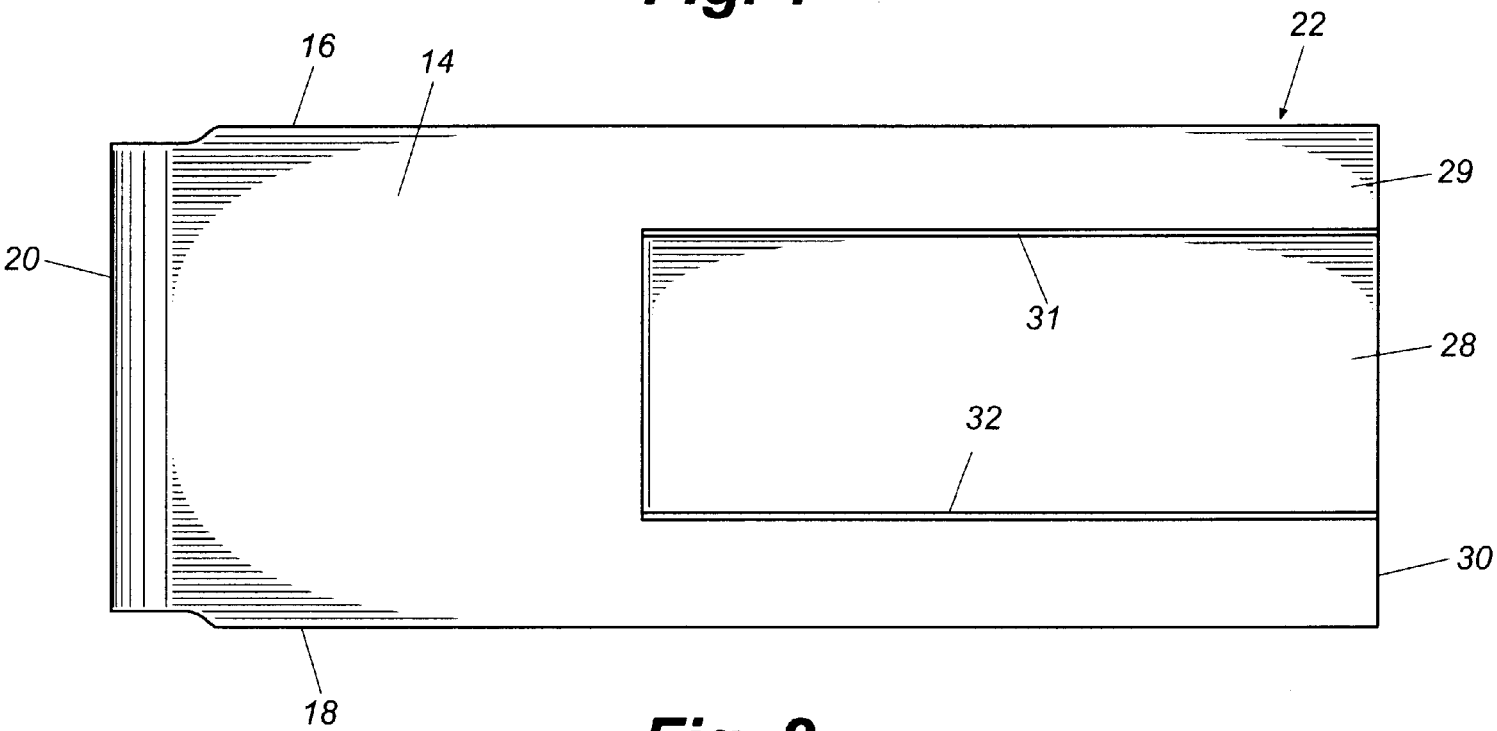
FIG. 2 is a plan view of the protector shoe.

Referring in more detail to the drawings, in which like numerals indicate like parts throughout the several views, FIG. 1 illustrates the protector shoe 10 before it has been applied to a support beam 12 of a building structure. The protector shoe is formed of sheet metal and includes a flat body panel 14 having opposed side edges 16 and 18 and a mounting edge 20 extending between the side edges 16 and 18. A tail 22 is formed at the fourth edge of the flat body panel 14.

A mounting flange 24 (FIG. 1) extends from mounting edge 20 and is formed at an angle with respect to the flat body panel 14. Usually, the angle A between the mounting flange 24 and the flat body panel 14 is an acute angle, formed so as to securely engage an edge of a support plate of a support beam 12. However, other angles can be employed as long as the function of engaging the edge of a support plate of a support beam is accomplished.

Tail 22 is formed in three strips, middle strip 28, and side strips 29 and 30 that straddle the middle strip 28. The strips are formed by intermediate slots 31 and 32 that are cut into the sheet metal of the protector shoe. The slots 31 and 32 are formed of a length so that the strips 28–30 will extend a distance sufficient to both overlie and extend beyond the second edge of a support plate of a support beam when the protector shoe is properly installed at the first or opposite edge of the support beam.

Figure 4:
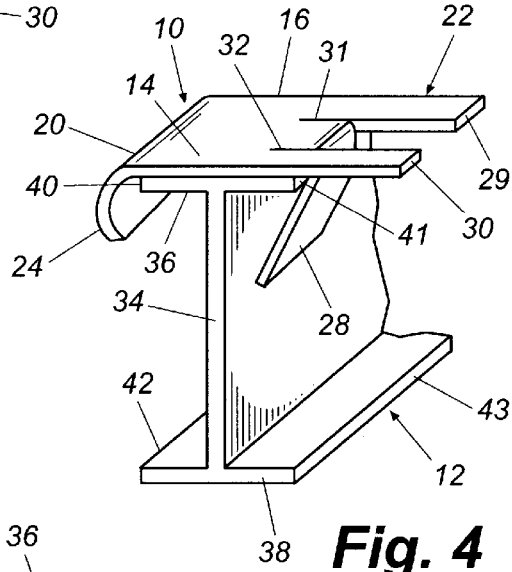
FIG. 4 is a perspective illustration of a support beam, with the protector shoe applied to the support beam before the tie down strap has been installed.

As illustrated in FIG. 4, the typical support beam of a premanufactured building structure is an I-beam which includes a central web 34 and opposed support plates 36 and 38 that are attached to opposed edges of the central web, forming an "I" shape. Typically, the first and second edges 40 and 41 of the upper support plate 36 and the first and second edges 42 and 43 of the lower support plate 38 are formed with relatively sharp angles and without smooth edges, for purposes of inexpensive manufacturing.

When a tie down strap 46 is to be applied to the support beam 12, the strap typically is looped about the support beam, with the end 47 of the tie down strap being connected to itself by a conventional clamp connector 48. The loop 49 surrounds the support beam.

Figure 3:
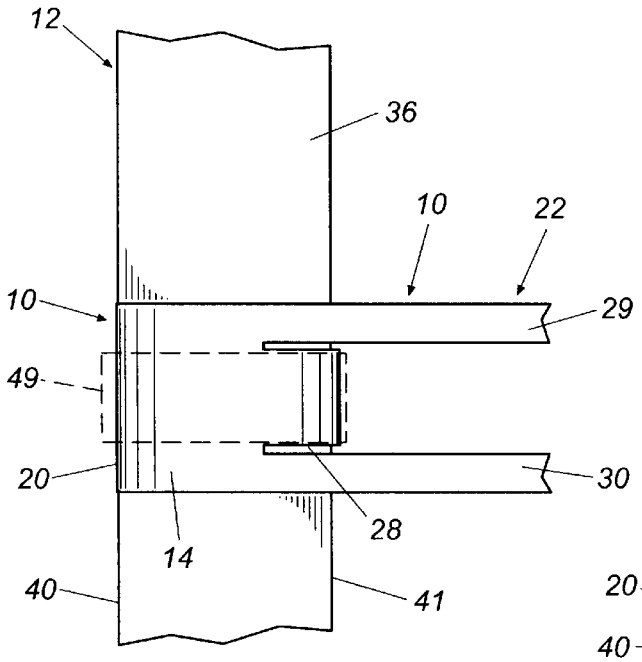
FIG. 3 is a plan view of the protector shoe as installed on a support beam, with the tie down strap shown in dashed lines.

Prior to forming the loop in the tie down strap, the protector shoe 10 is mounted on the support beam 12 in the manner illustrated in FIGS. 3 and 4. The flat body panel 14 is applied in flat abutment with the flat surface of the support plate 36 or 37 of the support beam, with the mounting flange 24 engaged about the first edge 40 or 42 of a support plate 36 or 38. This orients the protector shoe so that its tail 22 extends first in overlying relationship with the support plate 36 of the support beam and then beyond the second edge 41 or 43 of a support plate.

The installer can then bend the middle tail strip 28 (FIG. 4) about the second edge 41 or 43 of the support plate 36. Usually, this is sufficient to hold the protector shoe in place on the support plate.

The installer then forms the loop 49 (FIG. 5) in the tie down strap 46 with the strap material extending between the side strips 29 and 30 of the protector shoe. In this manner, the side strips 29 and 30 remain unfolded and tend to hold the protector shoe and the tie down strap in alignment with each other as the work progresses. The installer will then bring the free end 47 of the tie down strap together with the body portion of the tie down strap and apply the clamp connector 48 in a conventional manner, completing the loop of the tie down strap. In the meantime, the usual movements of the tie down strap caused by the installation proceedings will not disturb the position of the protector shoe with respect to the tie down strap, so that the tie down strap remains centered on the protector shoe by the tail strips 29 and 30 straddling the tie down strap.

Figure 5:
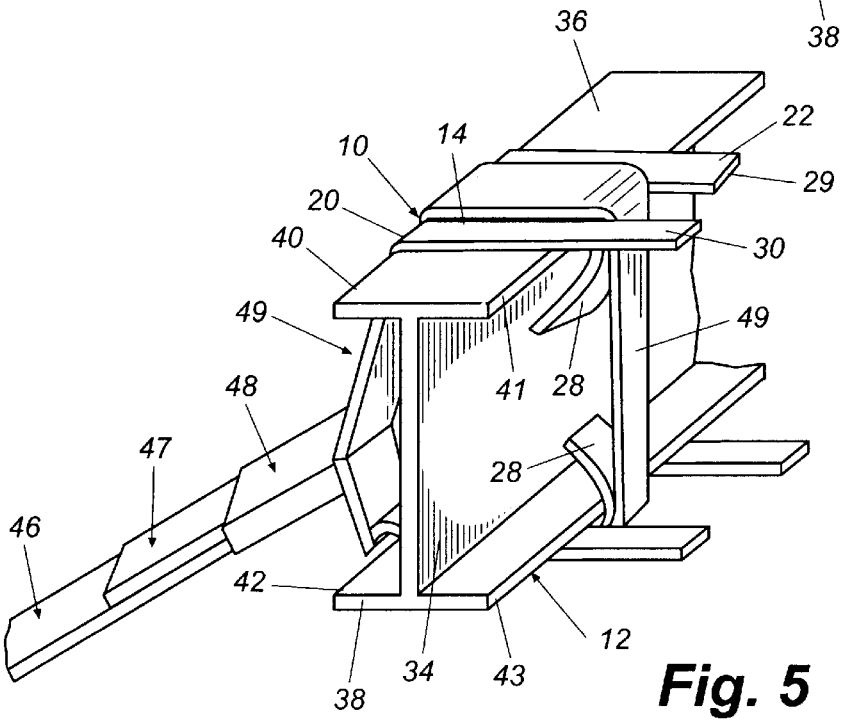
FIG. 5 is a perspective illustration, similar to FIG. 4, but showing the tie down strap installed about the support beam.

In most instances, the installer will apply protector shoes 10 to both the upper and lower support plates 36 and 38, as shown in FIG. 5. This assures that the loop 49 of the tie down strap material will not become abraded or otherwise damaged by the first and second edges 42 and 43 of the lower support plate 38. Also, because of the manner in which the mounting flange 24 and the folded middle tail strip 28 engage the bottom support plate 38, the protector shoe will not fall under the influence of gravity away from the support beam during the preliminary installation procedures.

From the foregoing description it can be understood that the mounting flange 24 of the protector shoe 10 functions as an edge engagement means formed on the mounting edge 20 of the flat body panel 14, and protects the tie down strap from engaging and damage from the first edge of the support plate of a support beam. Likewise, the folding of the middle strip 28 of the tail 22 about the second edge of the support plate protects the tie down strap from damage the second edge of the support plate. Typically, the width of the middle strip 28 of the tail is formed wider than the width of the tie down strap, and the distance between the side strips 29 and 30 is greater than the width of the tie down strap, so that the side strips can straddle the tie down strap, and the middle strip 28 provides a surface wider than the tie down strap against which the tie down strap engages.

Although a preferred embodiment of the invention has been disclosed in detail herein, it will be obvious to those skilled in the art that variations and modifications of the disclosed embodiment can be made without departing from the spirit and scope of the invention as set forth in the following claims.

What is claimed is:

1. A protector shoe assembly for engaging about a support beam of a tied down pre-manufactured building, the support beam including an intermediate web and opposed parallel support plates mounted to opposed edges of the intermediate web, the support plates having first and second opposed parallel edges, said protector shoe comprising:

a body panel for placement in overlying abutment on a support plate of a support beam, said body panel including opposed side edges, a mounting edge extending between said opposed side edges, and a tail opposed said mounting edge;

an edge engagement means formed on said mounting edge of said body panel and extending at an angle with respect to said body panel for engagement with and extending about a first edge of a support plate of a support beam, for holding said body panel on a support plate;

said tail defining a plurality of parallel strips oriented normal to said mounting flange and of a length for extending from overlying relationship with the support plate of a support beam to beyond the second opposed edge of a support plate;

at least one of said tail strips bent for extending about the second opposed edge of the support plate of the support beam; and a tie down strap extending about said engagement means, said body panel and said tail of said protector shoe;

so that said protector shoe protects said tie down strap from engagement with the opposed edges of the support plate of the support beam.

2. The protector shoe assembly of claim 1, wherein said tail comprises at least three parallel tail strips including a middle strip and side strips straddling said middle strip, said middle strip being bent about the second edge of the support plate of the support beam, and said tie down strap extending between said side strips.

3. The protector shoe assembly of claim 2, wherein said middle strip is of a width at least as great as the width of said tie down strap.

4. The protector shoe assembly of claim 2, wherein said tie down strap is urged against said middle strip for holding said middle strip in engagement with a second edge of a support plate of a support beam.

5. The protector shoe assembly of claim 1, wherein said tie down strap is formed in a loop for surrounding said protector shoe and a support beam on which the protector shoe is mounted.

6. The protector shoe assembly of claim 1, wherein said edge engagement means comprises a flange formed at an angle with respect to said body panel.

7. The protector shoe assembly of claim 6, wherein said mounting flange extends at an acute angle with respect to said body panel.

8. A protector shoe assembly for mounting on a support plate of a support beam of a pre-manufactured building structure between the support plate and a tie down strap and protecting the tie down strap from engaging the first and second opposed parallel edges of the support plate of a building support beam comprising:

a flat body panel formed of sheet metal and having opposed side edges, and a mounting edge extending between said side edges;

a mounting flange formed on said mounting edge of said body panel at an angle with respect to said body panel for engagement with a first edge of a support plate of a support beam;

a tail extending from said body panel opposed to said mounting edge;

said tail formed in strips and of a length for overlying a support plate and extending beyond the second edge of a support plate when the mounting flange engages the first edge of the support plate;

so that a tail strip can be bent about the second edge of the support plate in response to a tie down strap being urged toward the second edge of a support plate of a support beam; and wherein said tie down strap extends about the first and second opposed parallel edges of the support plate of a building support beam, the body panel and the tail.

9. The protector shoe assembly of claim 8, wherein said tail comprises three parallel strips including a middle strip and side strips straddling said middle strip;

said side strips being spaced apart a distance for straddling said tie down strap.

* * * * *